US010308417B2

(12) United States Patent
Vrabie et al.

(10) Patent No.: US 10,308,417 B2
(45) Date of Patent: Jun. 4, 2019

(54) PACKAGE CONVERTIBLE INTO A FRAME

(71) Applicant: Sergiu Vrabie, Chisinau (MD)

(72) Inventors: Sergiu Vrabie, Chisinau (MD); Andrei Santevoi, Chisinau (MD)

( * ) Notice: Subject to any disclaimer, the term of this patent is extended or adjusted under 35 U.S.C. 154(b) by 0 days.

(21) Appl. No.: 15/749,196

(22) PCT Filed: May 10, 2016

(86) PCT No.: PCT/EP2016/060469
§ 371 (c)(1),
(2) Date: Jan. 31, 2018

(87) PCT Pub. No.: WO2017/025209
PCT Pub. Date: Feb. 16, 2017

(65) Prior Publication Data

US 2018/0222662 A1 Aug. 9, 2018

(30) Foreign Application Priority Data

Aug. 7, 2015 (DE) ..... 20 2015 104 136 U

(51) Int. Cl.
*A63F 3/00* (2006.01)
*B65D 81/36* (2006.01)
(Continued)

(52) U.S. Cl.
CPC ..... *B65D 81/368* (2013.01); *A63F 3/0023* (2013.01); *A63F 9/1044* (2013.01);
(Continued)

(58) Field of Classification Search
CPC .. A63F 2003/00943; A63F 2003/00936; A63F 3/0023; A63F 3/0026;
(Continued)

(56) References Cited

U.S. PATENT DOCUMENTS 4,111,425 A 9/1978 Lathrop
5,370,397 A * 12/1994 Miller, Jr. ..... A63F 3/00088 273/248
(Continued)

FOREIGN PATENT DOCUMENTS

DE 297 08 302 U1 7/1997
DE 203 03 236 U1 7/2003
(Continued)

OTHER PUBLICATIONS

PCT/IB/338 dated Feb. 22, 2018, and the International Preliminary Report on Patentability ("IPRP") dated Feb. 13, 2018, from the corresponding PCT/EP2016/060469.
International Search Report and Written Opinion dated Jul. 27, 2016, from the corresponding PCT/EP2016/060469.
Russian Search Report dated Aug. 7, 2015, from the corresponding Russian Application No. 2015133014/12 (050875).
(Continued)

*Primary Examiner* — Benjamin Layno
(74) *Attorney, Agent, or Firm* — Katten Muchin Rosenman LLP

(57) ABSTRACT

Disclosed herein is a package convertible into a frame, comprising: a flat rectangular support plate, a rectangular frame element, and a rectangular lid element. The support plate, the frame element and the lid element are formed and arrangeable with respect to each other in such a way that in the package state the support plate is circumferentially grippable by at least a lower edge of an outer wall of the frame element. On an upper wall of the frame element parallel to the support plate the lid element is arranged so that a package in parallelepiped shape is created. In the frame state the frame element is arranged on a front surface of the support plate along its circumference, and the lid element is arranged either on a rear surface of the support plate or between a front surface of the support plate and the frame element.

13 Claims, 12 Drawing Sheets

Figure 1:
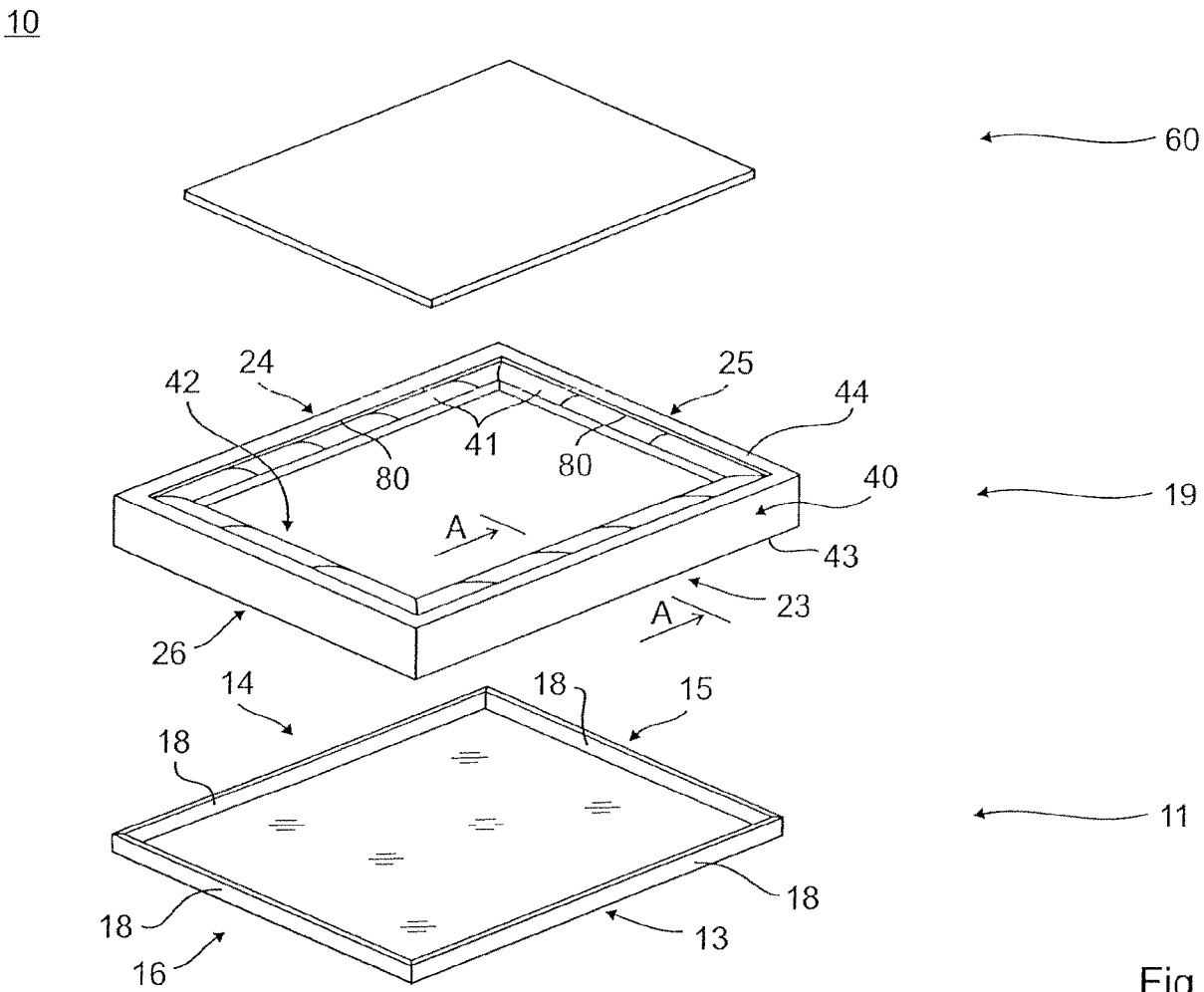

(51) Int. Cl.
*A63F 9/10* (2006.01)
*A63F 9/00* (2006.01)

(52) U.S. Cl.
CPC ..... *A63F 2003/00936* (2013.01); *A63F 2003/00943* (2013.01); *A63F 2003/00946* (2013.01); *A63F 2003/00949* (2013.01); *A63F 2003/00955* (2013.01); *A63F 2003/00962* (2013.01); *A63F 2009/0012* (2013.01); *A63F 2009/105* (2013.01)

(58) Field of Classification Search
CPC .. A63F 2003/00946; A63F 2003/00955; A63F 2003/00958; A63F 2003/00962; A63F 2003/00949; A63F 2003/0094; A63F 3/00
USPC ..... 273/283, 284, 285, 287, 309, 148 R, 273/153 R, 156, 157 R
See application file for complete search history.

(56) References Cited

U.S. PATENT DOCUMENTS

| | | | | |
|---|---|---|---|---|
| 6,345,822 | B1 * | 2/2002 | Reynolds | A63F 3/00261 273/281 |
| 2003/0067114 | A1 | 4/2003 | Morioka | |
| 2008/0282594 | A1 | 11/2008 | Swavola, II | |

FOREIGN PATENT DOCUMENTS

| | | |
|---|---|---|
| DE | 10 2011 115 255 B3 | 7/2012 |
| JP | 2007 320 595 A | 12/2007 |

OTHER PUBLICATIONS

German Search Report dated Mar. 22, 2016, from the corresponding German Application No. 202015104136.5.

* cited by examiner

A-A

A-A

PACKAGE CONVERTIBLE INTO A FRAME

The invention relates to a package convertible into a frame, which can be converted from a package state into a frame state.

From DE 10 2011 115 255 B3 a box for a puzzle is known consisting of a lower part and a lid, each having a base plate and several side walls forming an inner space. A puzzle arrangement frame having the dimensions of the completed puzzle and consisting of several frame parts is arranged on the base plate. The frame parts are movably arranged on the base plate and foldable from a position in which they protrude into the inner space to a position in which the completed puzzle is fixed.

The known box requires a relatively high amount of material, since the base area of the base plate is considerably larger than the size of the completed puzzle. Due to the large base area the box requires a large amount of space. This is cumbersome when the box is to be stowed away in a cupboard or on a shelf. Finally, the foldability of the frame parts increases the constructive complexity of the known box.

The task underlying the invention is to provide a package convertible into a frame which can be manufactured from a small amount of material, requires little space and can easily be converted from a package state into a frame state.

The task is solved in accordance with the invention by a package convertible into a frame having the features of claim 1. Advantageous developments of the inventive package are the subject of claims 2 to 14.

In the inventive package a support plate and a lid element are arranged in parallel to each other on the frame element congruently above each other in the package state, each forming a flat—that is, stepless—top side and bottom side of the package. The base area of the package is thus determined only by the size of the support plate, respectively the lid element. When the package is used to store a puzzle, for instance, the puzzle pieces can be stored in the space between the support plate and the lid element. The package can also be used for other purposes such as the storage of crayon drawings, a game board or the like.

The main technical task to be solved by the invention is a saving in material in the manufacture of the package, since essentially all sides of the package are formed by elements that can be used in the frame after the package has been converted into the frame.

The amount of material required for manufacturing the package is thus small. Moreover the package can be easily converted from the package state into the frame state and vice versa.

In the most preferred embodiment the profile of the upper wall of the frame element abutting on the upper edge of the outer wall of the frame element is formed with at least one step with an upper and a lower leg, wherein the upper leg is arranged closer to the outer wall of the frame element than the lower. The arrangement of the lid element on the lower leg of the step makes it possible to use the lid element as one of the sides of the package, which is formed as a parallelepiped. Due to the formation of the steps in identical profile for all four sides of the frame element, firstly a decorative element is formed which makes the frame more attractive, secondly the recession formed thereby and limited by the step is used to arrange the lid element therein, whereby the vertical dimension of the package is reduced. The lid element can be received in this recession under tension, which makes it possible to dispense with the usage of a retaining element for a fixation of the lid element in the recession formed by the step in the profile of the upper wall of the frame element in the package state.

Preferably the thickness of the lid element is equal to the height of the step, which facilitates a stepless, that is, plane formation of the surface formed by the lid element and the upper wall of the frame element, which in its turn renders the storage and unhindered shifting of the package in the horizontal plane easier.

The formation of a side wall at the circumference of the rear surface of the support plate facilitates an effective enlargement of the interior space of the package by an arrangement of the support plate with its front surface to the outside in the package state, thus increasing the distance between the support plate and the lid element in the package state by an additional distance corresponding to the height of the side wall. For a conversion of the package into the frame state, in this embodiment it is only required to turn the support plate around, arranging its front surface on the side of the upper wall of the frame element, respectively letting the outer surface of the sidewall abut on the inside of the lower edge of the outer wall of the frame element.

Preferably on the inside of each of the four outer walls of the frame element at least one support element with a support surface is formed, which protrudes from the lower edge of the outer wall by the height of the side wall of the support plate. In this case the side wall abuts on the support surface of the support element in the package state, so that the front surface of the support plate is arranged flush with the face of the lower edge of the outer wall of the frame element. These support elements determine the position of the support plate in the frame element surrounding it at its circumference. Most preferred is an embodiment of at least two protrusions on each of the insides of the outer walls of the frame element, simultaneously preventing a bending deformation of the support plate inserted into the frame element. For greater stability it is preferred to arrange the position of the support plate in the frame element on the inner surface of the corners of the frame element and to arrange at least one protrusion respectively in the centre of each of the four sides of the frame element.

A frame element whose upper wall comprises on its inside an arc-shaped end portion with an edge portion arranged in parallel to the outer wall has the highest practical and aesthetic value. The arrangement of the face of the edge portion of the upper wall of the frame element in the same plane as the support surface of the support element makes it possible to enlarge the contact area of the front surface of the support plate and the elements of the inside of the frame element, facilitating a more stable positioning of the support plate in the frame element as well as a reliable fixation of the lid element in the case of its arrangement between the support plate and the frame element.

In a preferred embodiment the support plate is formed semi-transparent, with a surface allowing diffuse light transmission, or completely transparent. This facilitates an illumination of the package in the frame state from behind. If the support plate is formed completely transparent, the content of the package can be seen through the support plate, or the support plate can be used as a transparent protective layer in this case if the lid element with the image attached on it is arranged on the rear surface of the support plate in the frame state.

The support plate can be formed either continuously or with a multitude of apertures or with a multitude of recessions or as a rigid grid with meshes of predetermined size, which greatly enlarges the scope of usage of the package. For instance, the multitude of apertures distributed on the entire surface of the support plate can be used for assembling a mosaic, the pieces of which require apertures for their assembly on the support plate. The package can also be used for assembling a 3D puzzle made on the horizontal surface of the support plate. The apertures or recesses distributed on the entire surface of the support plate make it possible to attach a 3D puzzle on a vertical surface, creating spatial or combined models or combined images. The apertures or recessions in the support plate can also be used for an even storage of some objects, as it is done with the arrangement of chocolates in a chocolate box on a special basis serving as a kind of storage organisation element. The manufacturing of the support plate as a rigid grid or with apertures arranged on the entire surface can serve to diminish its weight. Thus the manufacturing costs for the inventive package are reduced.

Preferably the lid element and the frame element and the support plate are held in their position in the package state by at least one fixing element.

In one embodiment the fixing element comprises two cover portions arranged at a distance above each other with two lateral edges extending at a right angle towards each other. The cover portions are connected by a side wall extending perpendicularly to them in the area of the lateral edges. The fixing elements are slid onto the opposite corners of the package in the package state.

The fixing element can also be formed as at least two clamps holding the elements together in the package state.

Alternatively the fixing element can be formed as one or several turnbuckles, drawing together the support plate and the lid element and extending through the cavity of the package formed between the support plate, the frame element and the lid element.

Another possible embodiment of the fixing element is a cardboard envelope completely surrounding the side of the package formed by the lid element and in its folded state surrounding only the edge of the support plate at its circumference with a band having a width of three to twenty percent of the width of the support plate, that is, of the distance between the opposite longitudinal sides. Preferably the width of the band amounts to four to ten percent of the width of the support plate. If the support plate is transparent, this embodiment of the fixing element enables a view on the contained package through the transparent support plate, maintaining the parallelepiped shape of the package.

If the frame element is formed in such a way that its outer wall can be fastened under tension to the lateral edges of the support plate in the package state as well as in the frame state, the use of the fixing element to fasten at least the support plate on the frame element is not necessary, while if the lid element is formed in such a way that by fastening its lateral sides under tension it can be fastened in the recess formed by the step in the profile of the upper wall of the frame element, the use of the fixing element for fastening also the lid element in the recess of the frame element is not necessary. Nevertheless a fixing element can be used in the package state also in the case of a fastening of the support plate or the lid element in the frame element under tension in order to achieve a higher degree of reliability of the fastening of the lid element, the frame element and the support plate.

Preferably the support plate comprises several apertures arranged at a distance from each other adjacent to the circumference. The frame element comprises protrusions formed so that they engage with the apertures in the frame state and in the package state. Thus a secure grip of the frame elements in the frame state as well as in the package state is ensured.

This secure grip can be further improved by at least partial coverage of the inner surface of the apertures with an elastic material having a thickness that enables a retention of the protrusions of the frame elements under tension.

To obtain a visually attractive continuous frame, the length of the transverse legs of the frame element between the corresponding corners of the legs limiting them essentially corresponds to the length of the transverse side of the support plate, and the length of the longitudinal legs of the frame element between the corresponding corners of the legs limiting them essentially corresponds to the length of the longitudinal side of the support plate.

Figure 2:
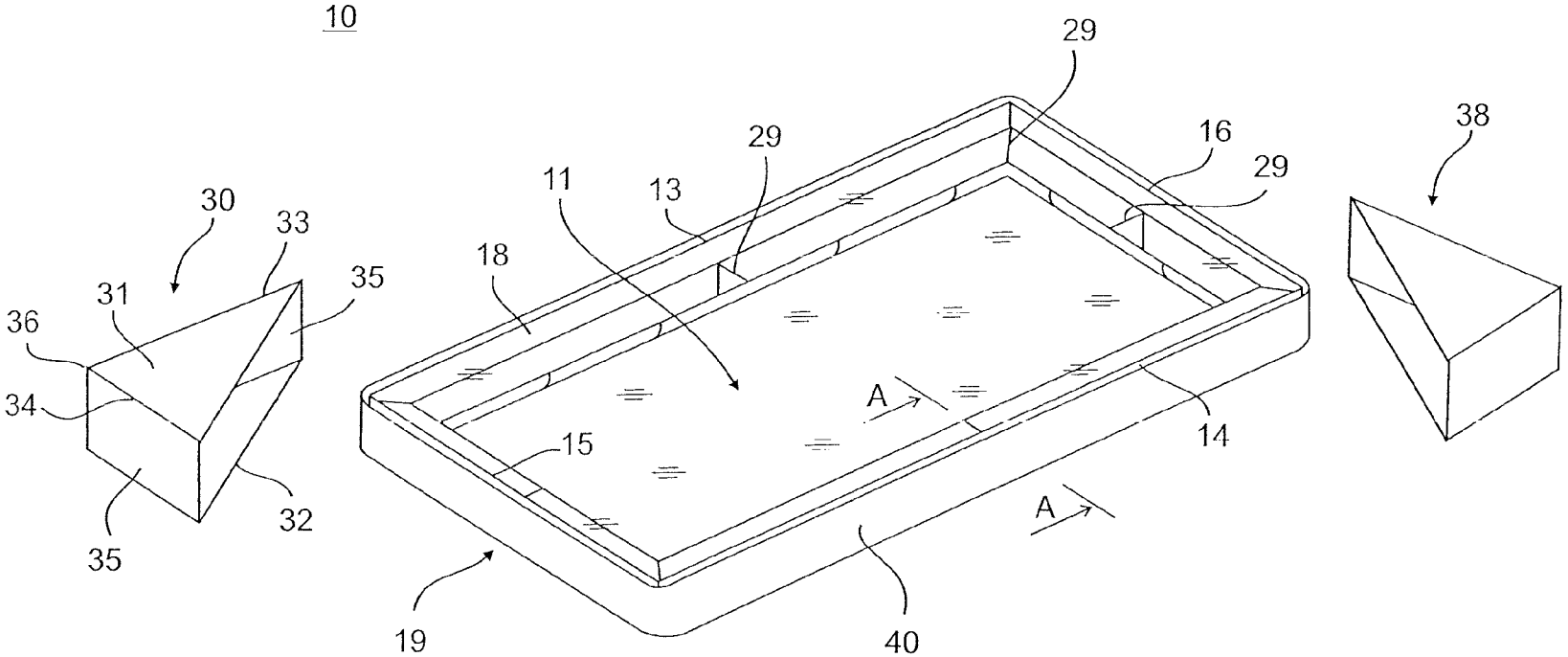
Figure 3:
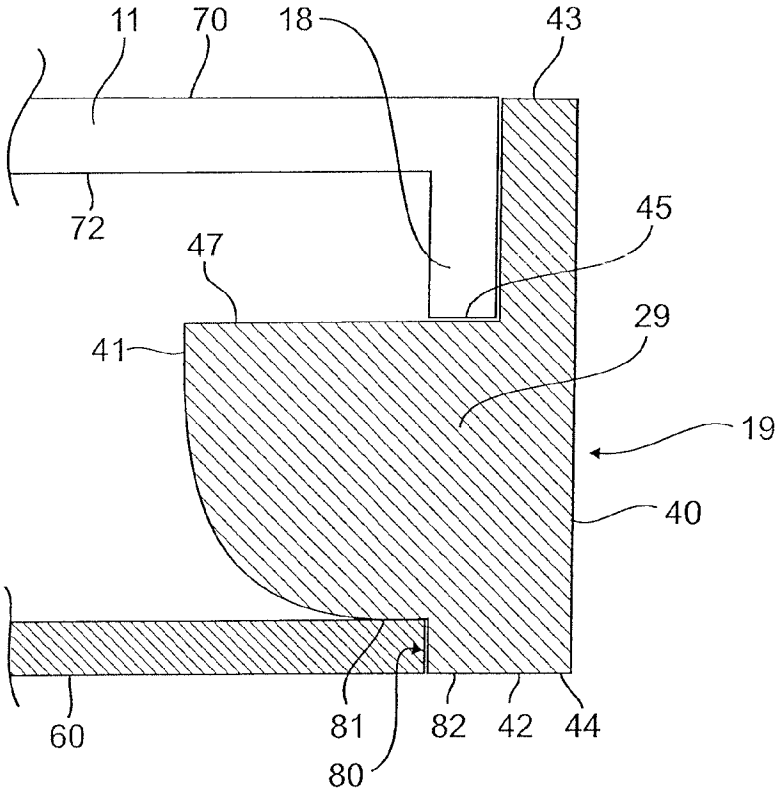
Figure 4:
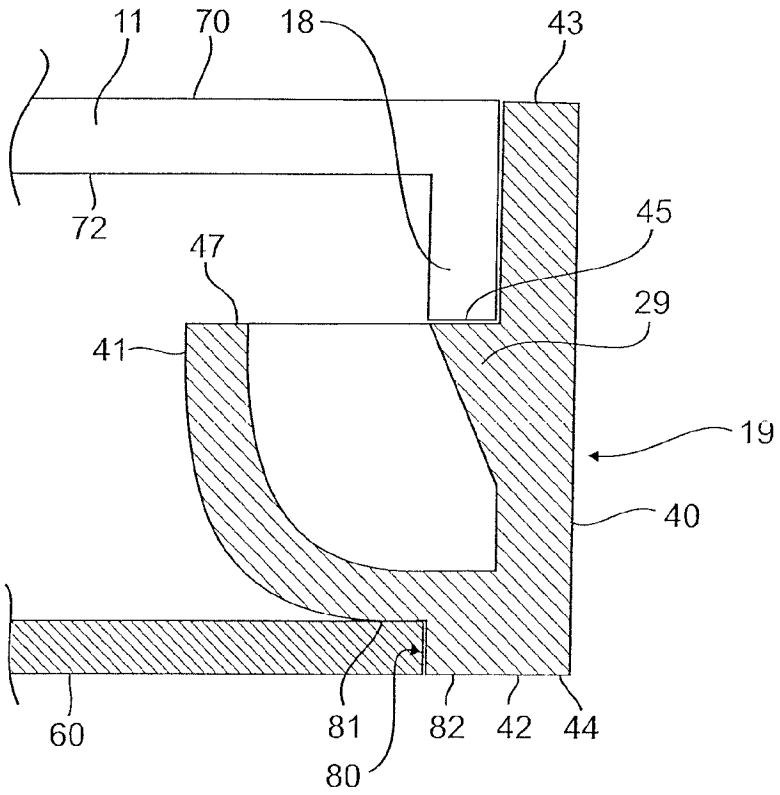
Figure 5:
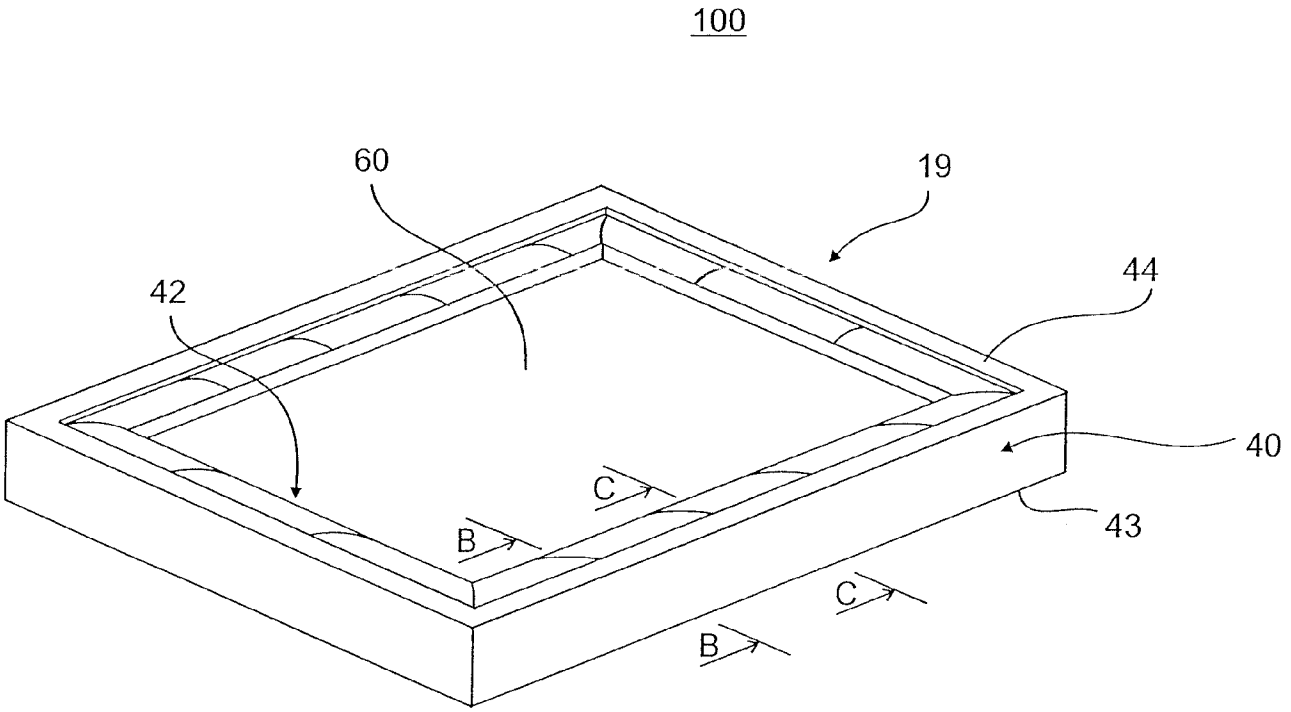
Figure 6B:
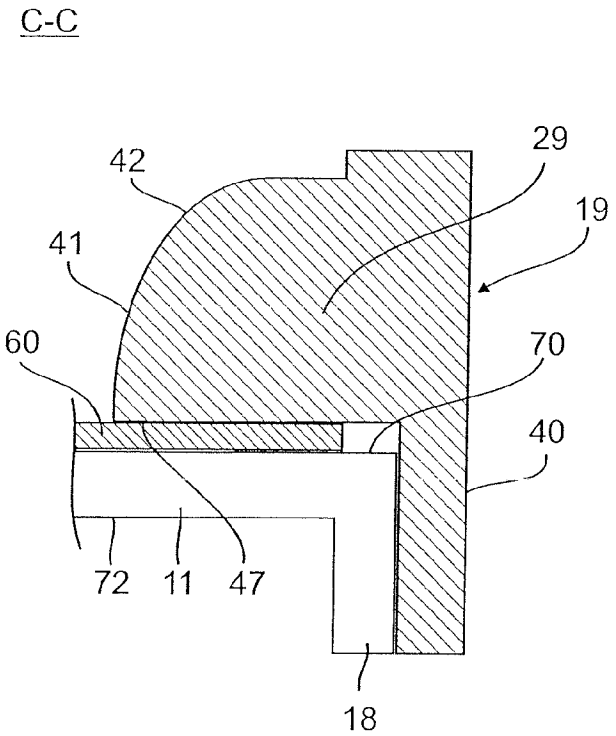
Figure 6A:
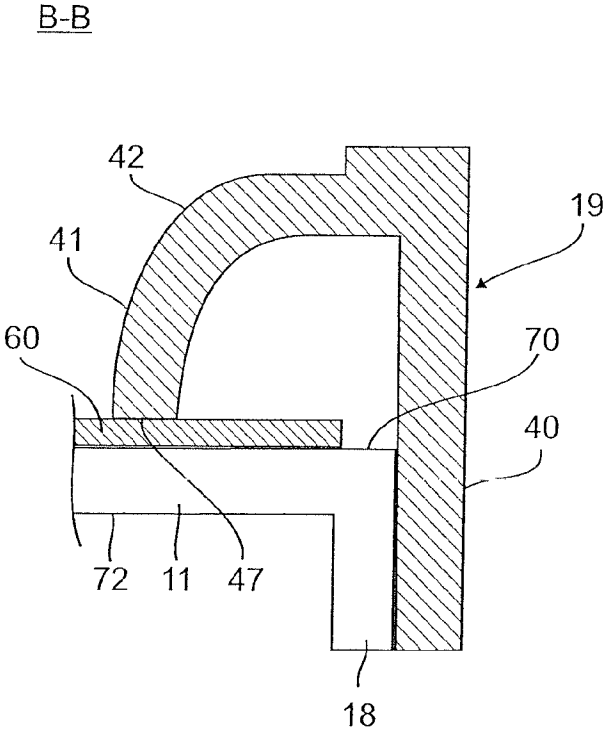
Figure 7:
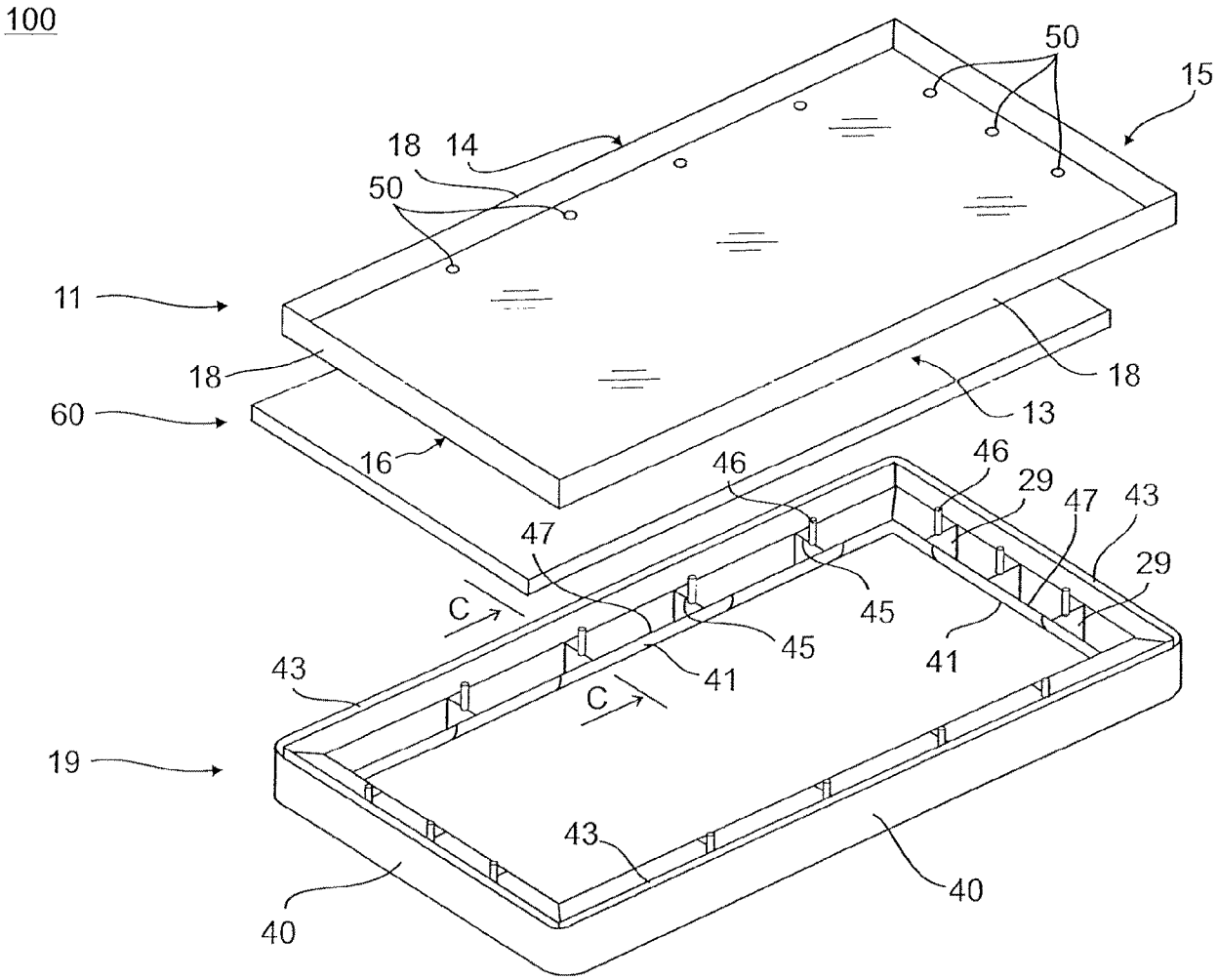
Figure 8:
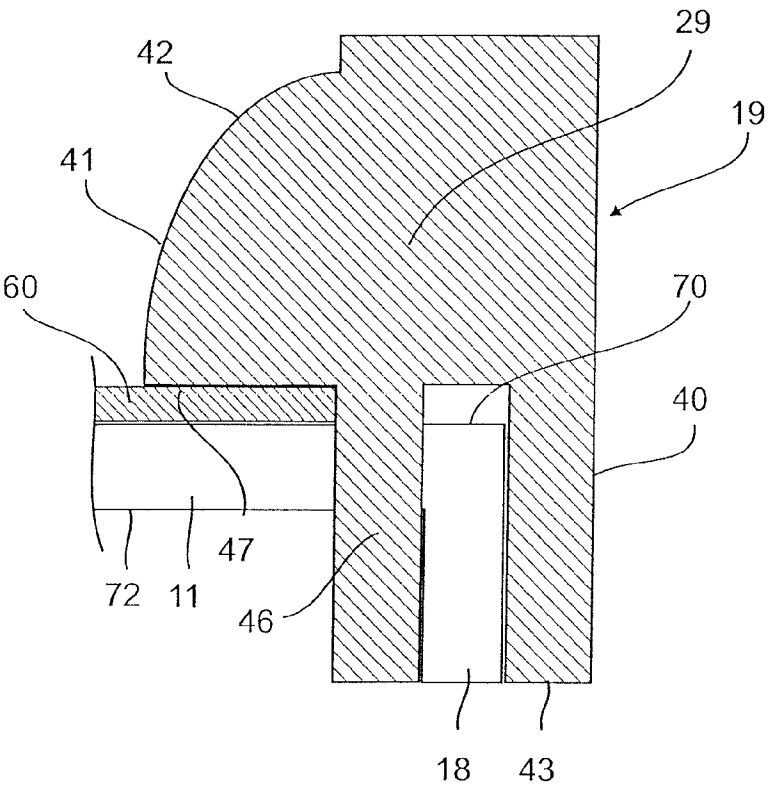
Figure 9:
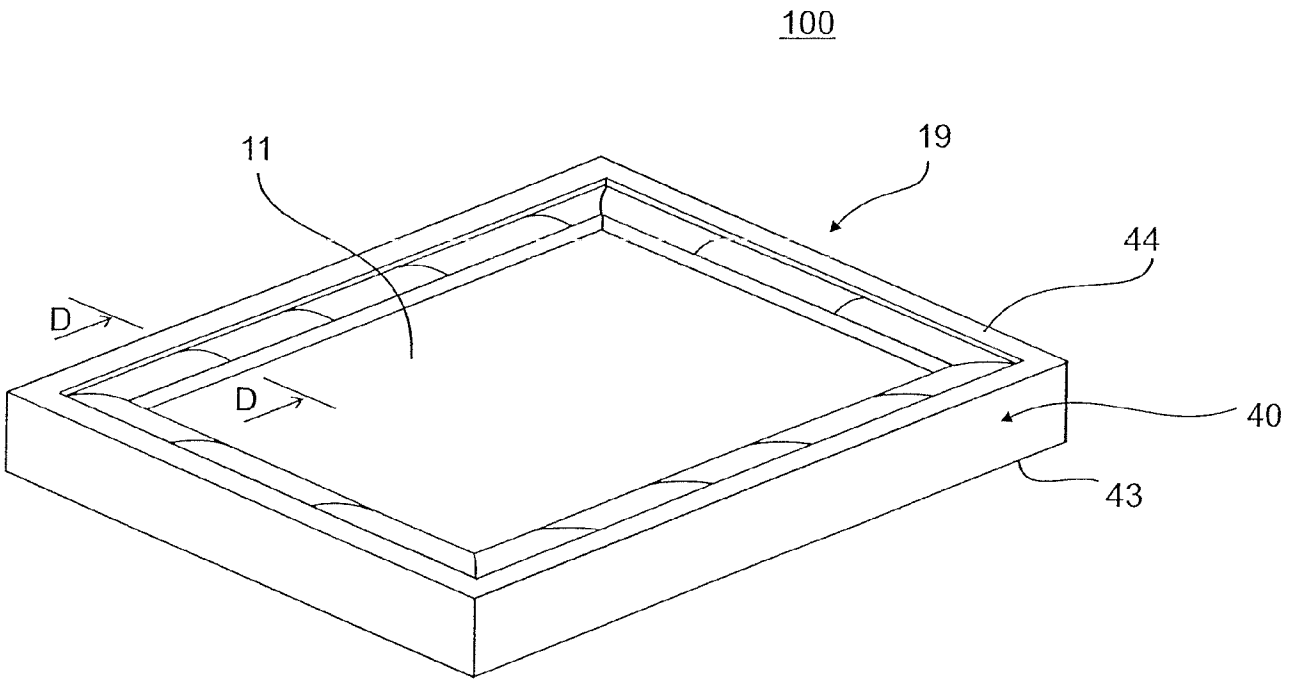
Figure 10:
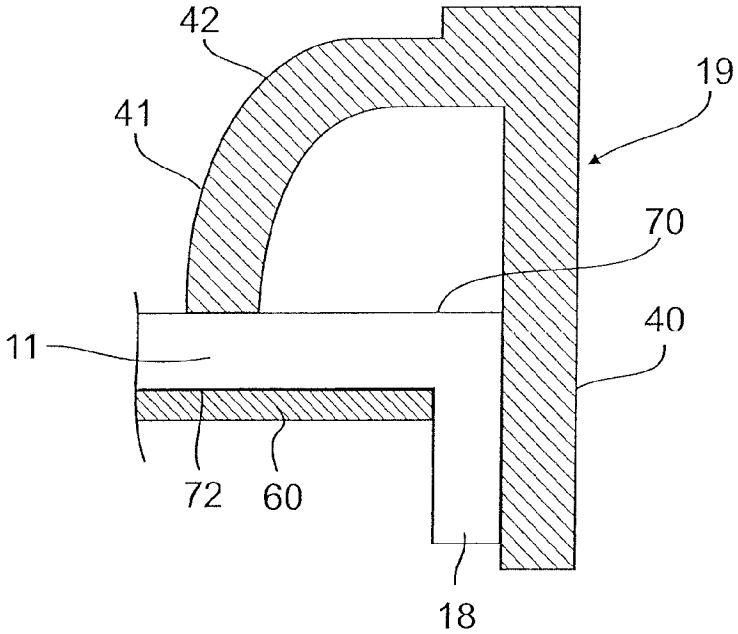
Figure 11:
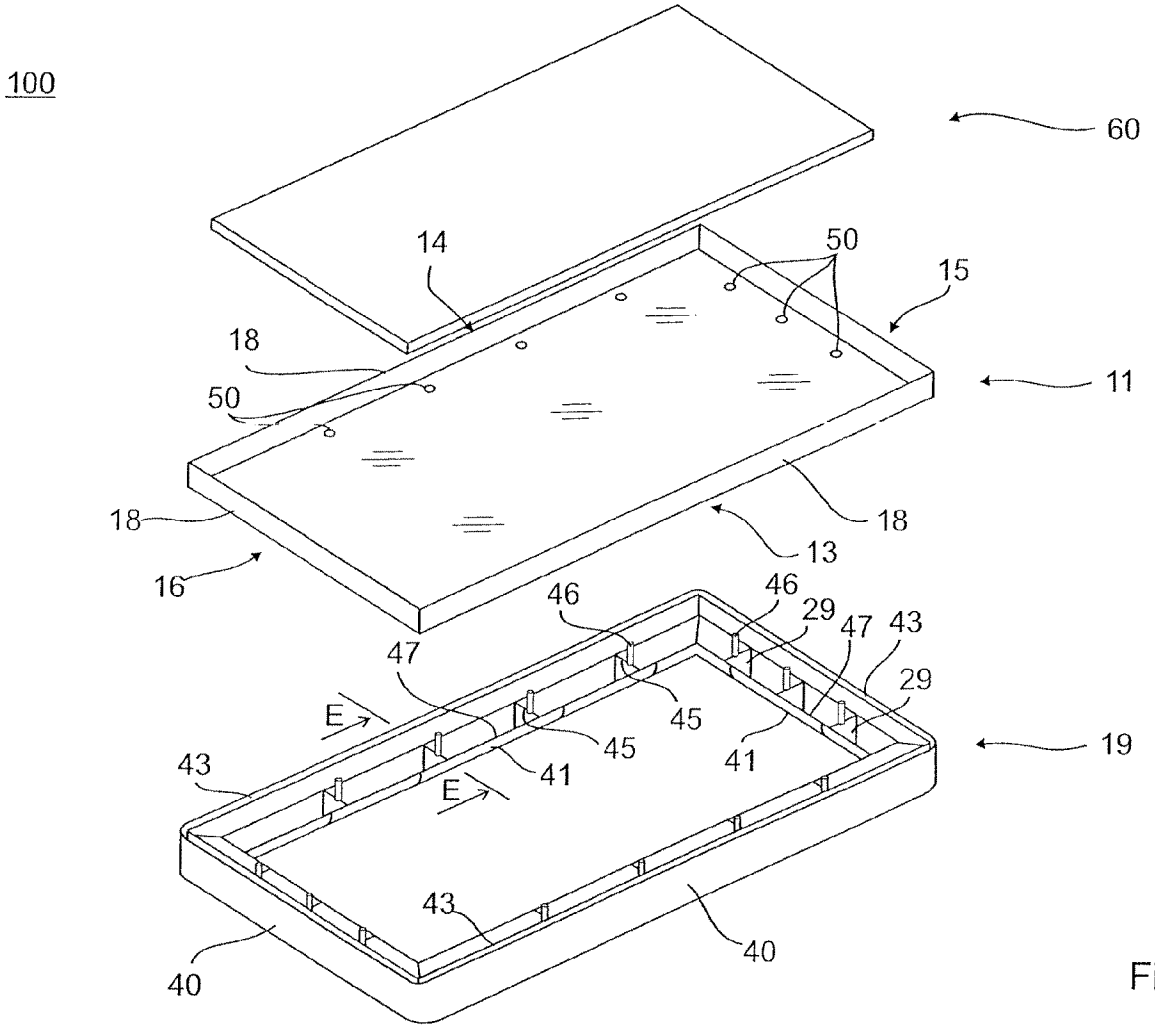
Figure 12:
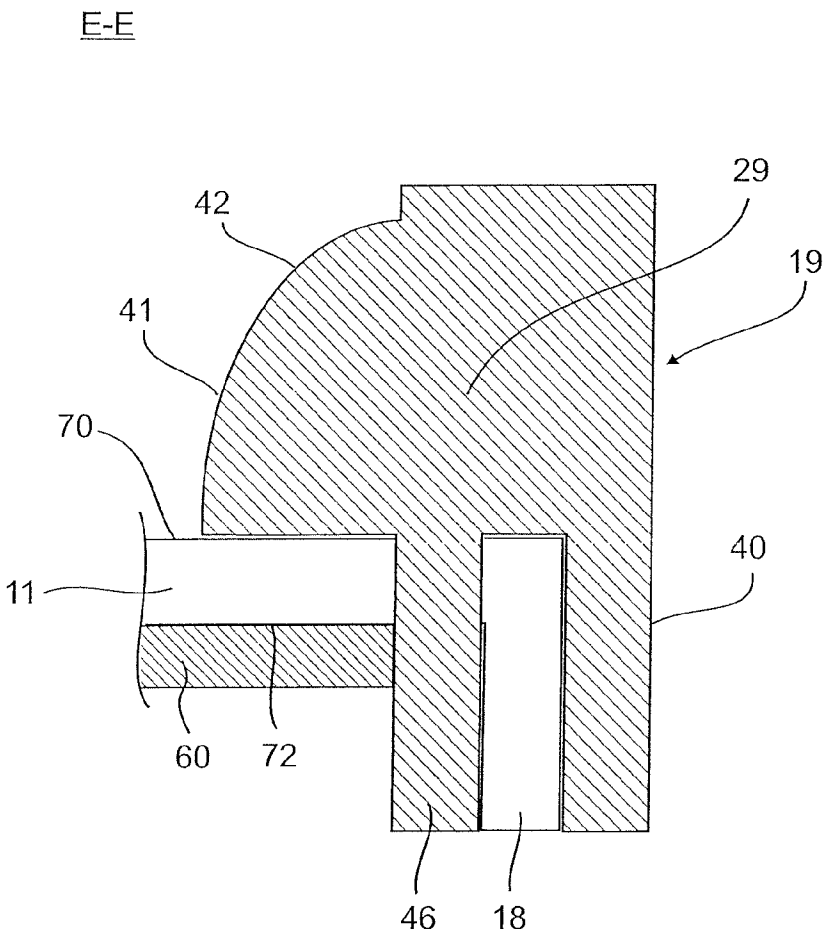

Embodiments of the invention will be explained in more detail based on the drawings, in which:

FIG. 1 shows a perspective view of a package convertible into a frame with elements arranged at a spatial distance to each other in the package state, FIG. 2 shows a perspective view of a package convertible into a frame with fixing elements arranged at a distance from the package, FIG. 3 shows the arrangement of parts in the package state in section A-A of FIG. 2, FIG. 4 shows a further possible embodiment of the support element of the package in section A-A of FIG. 2, FIG. 5 shows a perspective view of the first embodiment of the package convertible into a frame in the frame state, FIG. 6*a* shows the arrangement of the parts in the frame state in section B-B of FIG. 5, FIG. 6*b* shows the arrangement of the parts in the frame state in section C-C of FIG. 5, FIG. 7 shows a perspective view of a second embodiment of the package in the frame state with elements arranged at a spatial distance to each other, FIG. 8 shows a view of the package in the frame state according to the second embodiment in section C-C of FIG. 7 (rotated), FIG. 9 shows a third embodiment of the frame in perspective, FIG. 10 shows the arrangement of the elements in the package according to the third embodiment in the frame state in section D-D of FIG. 9 (rotated), FIG. 11 shows a perspective view of a fourth embodiment of the package in the frame state with elements arranged at a spatial distance to each other, FIG. 12 shows a view of the package in the frame state according to the fourth embodiment in section E-E of FIG. 11.

FIG. 1 shows a perspective view of a preferred embodiment of the package 10 with elements arranged at a spatial distance to each other. The package 10 comprises a flat rectangular support plate 11 with a side wall 18 arranged at its circumference, a frame element 19 and a rectangular lid element 60, wherein in the package state the lid element 60 and the support plate 11 are arranged at a spatial distance from each other on a frame element 19 congruently above each other and parallel to each other, wherein the frame element 19 serves as a spacer keeping the lid element 60 and the support plate 11 at a predetermined distance to one another without their abutting in the package state.

The support plate 11 consists of transparent material and comprises two opposite longitudinal sides 13, 14 and two opposite transverse sides 15, 16 extending perpendicularly to them. The support plate 11 comprises a front side 70 and a rear side 72 (see FIGS. 3, 4, 6*a*, 6*b*, 8, 10, 12), wherein the front side 70 of the support plate 11 is situated at the bottom in FIG. 1 and the rear side 72 faces upwards. Alternatively the support plate 11 can be formed either continuous and non-transparent or with a multitude of apertures or as a rigid grid with meshes of predetermined size. It is important that the support plate 11 is sufficiently rigid to maintain its shape during the mounting and dismounting of the frame element 19 and not bend in the package state under the impact of stresses that are usual for functional packages. On each of the lateral sides 13, 14, 15, 16 of the support plate 11 on its rear surface 72, i.e. in FIG. 1 on the side facing the frame element 19, a continuous side wall 18 is formed, wherein in a section through a plane extending in parallel to the support plate 11 the distance between the outer edges of the opposite walls 18 is constant in its entire height.

Alternatively (not shown in FIG. 1) the wall 18 can be formed discontinuously or as individual protrusions.

The frame element 19 is positioned between the support plate 11 and the lid element 60 parallel to them.

The frame element 19 comprises longitudinal sides 23, 24 and transverse sides 25, 26 extending at a right angle towards each other. The length of the longitudinal sides 23, 24 essentially corresponds to the length of the longitudinal sides 13 and 14, respectively, of the support plate 11, while the length of the transverse sides 25, 26 corresponds to the length of the transverse sides 15 and 16, respectively, of the support plate 11.

The frame element 19 comprises a surrounding outer wall 40 forming the outside of the frame element 19. The outer wall 40 comprises a lower edge 43 and an upper edge 44, wherein in the package state the support plate 11 is arranged in the frame element 19 on the side of the lower edge 43, while the lid element 60 is arranged on the side of the upper edge 44 of the upper wall 40 of the frame element 19. At the upper edge 44 on the inside of the frame element 19 the upper wall 42 of the frame element 19 abuts, the outer circumference of which is formed identically along each of the longitudinal and transverse sides 23, 24, 25 and 26 of the frame element 19. The cross profile of the upper wall 42 of the frame element 19 is formed with a step 80 with an upper leg 82 and a lower leg 81 (see FIG. 3 and FIG. 4). The step 80 is formed with uniform height and at a uniform distance from the outer wall 40 along the entire length of the longitudinal and transverse sides 23, 24, 25, 26 of the frame element 19. Starting at the lower leg 81 the upper wall 42 extends in an arc shape downwards, that is, in the direction from the upper edge to the lower edge of the outer wall 40 of the frame element 19 to the inside, with an edge portion 41 extending parallel to the outer wall 40, the lower edge of which extends parallel to the lower edge of the outer wall 40 and ends above it relative to the plane of the frame element 19, as shown in FIG. 3 and FIG. 4. Thus on the bottom side of the frame element 19 a tub-shaped recess is formed. Support elements 29 are attached at the bottom of this tub-shaped recess at regular intervals along each of the sides 23, 24, 25, 26 as separating walls in the tub-shaped recesses, their support surface 45 extending perpendicularly to the outer wall 40. The support surface 45 of the support elements 29 serves for the arrangement of the face of the side wall 18 of the support plate 11 thereon in the package state. The support surface 45 protrudes from the lower edge 43 of the outer wall 40 by the height of the wall 18 so that when the wall 18 abuts on the support surface 45 of the support element 29 in the package state the front surface 70 of the support plate 11 is arranged flush with the face of the lower edge 43 of the outer wall 40. Thus it is possible to form one of the surfaces of the package formed by the support plate 11 and the face of the lower edge 43 of the outer wall 40 of the frame element 19 as a plane surface without steps.

Instead of the embodiment of the support element 29 as a continuous separating wall in a tub-shaped recess as shown in FIG. 3, the support element 29 can be formed on the rear side of the outer wall 40 as a protrusion with a section plane that is triangular in longitudinal section, the support surface 45 of which lies in the same plane as the face 47 of the inner edge portion 41 of the upper wall 42, as shown in FIG. 4. The support surface 45 extends from the inner surface of the outer wall 40 of the frame element 19 into the inside of the frame element 19 at a distance corresponding to the thickness of the side wall 18 of the support plate 11. This embodiment of the support element 29 facilitates a further saving in the material of which the frame element 19 consists.

As shown in FIG. 3 and FIG. 4, in the package state the outside of the side wall 18 of the support plate 11 abuts tightly on the lower part of the inside of the outer wall 40 of the frame element 19, while the lower part is adjacent to the lower edge 43 of the outer wall 40. This makes it possible to fasten the outer wall 40 of the frame element 19 under tension on the lateral sides 13, 14, 15, 16, respectively on the side wall 18 of the support plate 11.

The rectangular lid element 60 is formed continuously and non-transparent with a sufficient degree of rigidity to withstand bending deformation when used as one of the sides of the package as shown in FIG. 1. Typical forces in the field of use of the package are, for instance, forces caused by gripping movements of the fingers of the hand when the package is gripped with the fingers from two sides. The length of the lid element 60 corresponds to the length of the step 80 of the profile of the upper wall 42 of the frame element 19 on its longitudinal sides 23, 24; correspondingly, its width corresponds to the length of the step 80 on its transverse sides 25, 26. This makes it possible to arrange the lid element 60 on the lower leg 81 of the step 80. As shown in FIG. 3 and FIG. 4, the thickness of the lid element 60 equals the height of the step 80, which facilitates a stepless formation of the side of the package formed by the lid element 60 and the upper leg of the step 80, wherein the surface of the lid element 60 that faces outwards is arranged flush with the upper leg 82 of the step 80. Alternatively the thickness of the lid element 60 can differ from the height of the step 80. Preferably that difference is not more than 30% of the height of the step 80 (not shown). If necessary, in accordance with an embodiment of the invention the lid element 60 is formed in such a way that it can be fastened in the recess formed by the step 80 of the profile of the outside of the upper wall 42 of the frame element 19, by fastening its lateral sides under tension, to avoid the use of additional elements for fastening the lid element 60 on the frame element 19. According to a further embodiment of the package shown in FIG. 1, the dimension of the lid element 60 corresponds to the outer dimension of the outer wall 40 of the frame element 19. According to this embodiment of the package, however, the use of at least one of the embodiments of the fixing elements listed below is required.

FIG. 2 shows the package 10 in reverse view with respect to FIG. 1, so that the support plate 11 is positioned at the top while the lid element 60 (not shown in FIG. 2) is at the bottom. One of the possible versions of holding the support plate 11, the frame element 19 and the lid element 60 together is shown in FIG. 2, in which the package elements are held together by two fixing elements 30, 38, shown in FIG. 2 in a position before being put on the corresponding opposite corners of the package 10.

Each fixing element 30, 38 comprises two equally sized cover portions 31, 32 arranged congruently above each other and shaped as a rectangular triangle with an apex 36, from which two lateral edges 33, 34 extend at a right angle towards each other. The lateral edges 33, 34 of the upper cover portion 33 and the lower cover portion 32 are connected by a side wall 35 extending perpendicularly to the cover portions 31, 32. In the area of the hypotenuse of the cover portions 31, 32 there is no side wall. The distance between the cover portions 31, 32 corresponds to the distance between the lid element 60 and the support plate 11 in the package state shown in FIG. 2. The fixing elements 30, 38 are put on opposite corners of the package 10.

Alongside the use of the fixing elements 30, 38 shown in FIG. 2, other embodiments of the fixing elements are also possible. For instance, the fixing elements can be formed as two clamps (not shown) holding the lid element 60, the frame element 19 and the support plate 11 in the package state. Alternatively the above-mentioned package elements can be held together by gluing on flat self-adhesive elements on adjacent portions of the support plate and the frame element, respectively of the lid element and the frame element (not shown). Alternatively the fixing element can be formed as a turnbuckle extending through the cavity of the package in the package state, connecting the support plate and the lid element in at least one point (not shown). Moreover, as stated above, instead of the use of the fixing elements the support plate and the lid element can be held together by the frame element by keeping them under tension in the frame element.

To convert the package 10 shown in FIG. 2 into a frame 100, the first embodiment of which is shown in FIG. 5 and FIG. 6*a*, FIG. 6*b*, the lid element 60 is taken out of the recess formed in the frame element 19 by the step 80, and is placed on the face 47 of the edge portion 41 of the upper wall 42 of the frame element 19 on the side of the lower edge 43 of the outer wall 40 of the frame element 19; subsequently the support plate 11 is placed onto the lid element 60 on the side of the lower edge 43 of the outer wall 40, wherein the front surface 70 of the support plate 11 abuts on the lid element 60. The fastening of the support plate 11 in the frame element 19 is achieved by bracing engagement of the outside of the side wall 18 of the support plate 11 with the inside of the outer wall 40 of the frame element 19 under tension, as shown in the section in FIG. 6*a* and FIG. 6*b*. To fix the position of the lid element 60 between the inner edge portion 41 of the upper wall 42 and the support plate 11, protrusions (not shown) can be formed on the inside of the upper wall 42 or the outer wall 40 in the plane in which the lid element 60 is arranged, preventing a sideways shift of the lid element 60.

FIG. 6*a* schematically shows a cross-section of the package converted into a frame on a portion of the frame element 19, wherein the inner surface of the upper wall 42 of the frame element 19 is formed as a recess not containing a support element. In FIG. 6*b* a cross-section is shown on a portion of the frame element 19 comprising a support element 29 formed as a continuous separating wall in the above-mentioned recess formed on the inside of the outer wall 42. On this portion of the frame element 19 the contact area between the frame element 19 and the lid element 60 is enlarged compared to the portion of FIG. 6*a*.

FIG. 7 and FIG. 8 show a second embodiment of the package converted into a frame, whose difference to the first embodiment shown in FIGS. 5 and 6*a*, 6*b* is that pin-shaped protrusions 46 are formed on the support elements 29 extending in parallel to the outer wall 40, wherein the lower end of the pins 46 is situated at the level of the lower edge 43 of the outer wall 40 of the frame element 19, that is, in the plane extending through the lower edge 43 of the outer wall 40 parallel to the plane of the frame element 19. Preferably the pins 46 protrude from the inner surface of the outer wall 40 of the frame element 19 by the thickness of the side wall 18 of the support plate 11.

As can be seen in FIG. 7, apertures 50 are formed adjacent to the outer circumference of the support plate 11 on the inside from the side wall 18. The apertures 50 are arranged so that the pins 46 on the frame element 19 engage with these apertures when the frame element 19 is put on in such a way that the inside of its outer wall 40 abuts on the outside of the side wall 18, as can be seen from FIG. 8.

The frame element 19 can be slid onto the circumferential portions of the support plate 11 until the face 47 of the edge portions 41 rests on the front side 70 of the support plate 11. However, they can also be shifted upwards by a certain amount, so that the lid element 60 and a sheet of paper, cardboard or the like can be pushed under the face 47 of the edge portion 41.

The apertures 50 in the support plate 11 are arranged so that the pins 46 of the frame element 19 extend through it in the position shown in FIG. 8, that is, when the front surface 70 of the support plate 11 faces the side of the upper wall 42 of the frame element 19, as well as in the reverse position, as shown, for instance, in FIG. 3 and FIG. 4 (without the pins 46), that is, in a position where the rear surface 72 of the support plate 11 faces the side of the upper wall 42 of the frame element 19. This facilitates a secure fastening of the support plate 11 in the frame element 19 in the frame position as well as in the package position.

FIGS. 9 and 10 show a third embodiment of the package convertible into a frame 100 in analogy to the embodiment shown in FIG. 5 and FIG. 6*a*, 6*b*, but differing in that the lid element 60 is arranged at the rear surface of the support plate 11 in the frame state. In this embodiment the longitudinal and transverse dimensions of the lid element 60 correspond to the distances between the inner surfaces of the corresponding side walls 18 of the support plate 11. Thus the lid element 60 can be arranged between the side walls 18 of the support plate 11 and be laterally fixed in its position; or alternatively can be fastened under tension between the side walls 18. If the support plate 11 is transparent, this embodiment facilitates the creation of an effective mechanical protection of the image attached to the surface of the lid element 60 abutting on the rear surface 72 of the support plate 11. Alternatively the lid element 60 can be fixed in its position shown in FIG. 10 by any known method, for instance by gluing, by gluing adhesive elements on the edge portions and the like.

FIG. 10 shows the cross-section of a portion of the frame element 19 without a support element. At the portion of the frame element with the support element 29 the cross-section of the frame element 19 looks the same as in FIG. 6*b*.

In FIG. 11 and FIG. 12 a fourth embodiment of the package converted into a frame is shown, which differs from the second embodiment shown in FIG. 7 and FIG. 8 only by the sequence of arrangement of the elements with regard to one another, namely, in accordance with the fourth embodiment (FIG. 11, FIG. 12) the front surface 70 of the support plate 11 abuts on the inner edge portion 41 of the upper wall 42 of the frame element 19, while the lid element 60 is arranged abutting on the rear surface 72 of the support plate 11. The transverse dimensions of the lid elements 60 in this embodiment are such that the lid element 60 is fastened under tension between the pins 46 of the frame element 19 on the rear surface 72 of the support plate 11.

Preferably all parts are injection-moulded plastic parts that can be manufactured in large amounts at low costs.

LIST OF REFERENCE NUMBERS

10—package
11—support plate
13, 14—longitudinal sides of the support plate 11
15, 16—transverse sides of the support plate 11
18—side wall of the support plate 11
19—frame element
23, 24—longitudinal sides of the frame element 19
25, 26—transverse sides of the frame element 19
29—support elements
30, 38—fixing element
31, 32—cover portion of the fixing element 30, 38
33, 34—lateral edges of the fixing element 30, 38
35—side wall of the fixing element 30, 38
40—outer wall of the frame element 19
41—inner edge portion of the upper wall 42 of the frame element 19
42—upper wall of the frame element 19
43—lower edge of the outer wall 40 of the frame element 19
44—upper edge of the outer wall 40 of the frame element 19
45—support surface of the protrusion 29
46—pins of the frame element 19
47—face of the edge portion 41
50—apertures at the circumference of the support plate 11
60—lid element
70—front surface of the support plate 11
72—rear surface of the support plate 11
80—step of the profile of the upper wall 42 of the frame element 19
82—upper leg of the step 80
84—lower leg of the step 80
100—package 10 converted into frame

The invention claimed is:

1. A package (10) convertible into a frame, comprising:

a flat rectangular support plate (11) comprising a front surface (70) and a rear surface (72), a rectangular frame element (19) comprising an outer wall (40) arranged at its outer circumference with a lower and an upper edge (43, 44) and an upper wall (42) of the frame element (19) adjoining with the upper edge (44) on the inside of the frame element (19), and a rectangular lid element (60), characterised in that the support plate (11), the frame element (19) and the lid element (60) are formed and arrangeable with respect to each other in such a way that in the package state the support plate (11) is adapted to be circumferentially grippable by at least the lower edge (43) of the outer wall (40) of the frame element (19), and on the upper wall (42) of the frame element (19) parallel to the support plate (11) the lid element (60) is arranged so that a package in parallelepiped shape is created, wherein the support plate (11) and at least the lid element (60) form the top and the bottom side of the package (10), and the outer wall (40) of the frame element (19) forms the side walls of the package, and in the frame state the frame element (19) is arranged on the front surface (70) of the support plate (11) along its circumference, the lid element (60) is arranged either on the rear surface (72) of the support plate (11) or between the front surface (70) of the support plate (11) and the frame element (19), wherein the profile of the upper wall (42) of the frame element (19) is formed with at least one step (80) with an upper (82) and a lower leg (81), which step is lowered towards the side of the opposite outer wall (40), wherein the length and width of the lid element (60) enable an arrangement of the lid element (60) on the lower leg (81) of the step (80).

2. The package according to claim 1, in which the thickness of the lid element (60) is equal to the height of the step (80).

3. The package according to claim 1, in which a continuous or discontinuous side wall (18) is formed on the lateral sides (13, 14, 15, 16) of the support plate (11) on the side of its rear surface (72), wherein the front surface (70) of the support plate (11) faces outward in the package state.

4. The package according to claim 3, in which the frame element (19) comprises at least one support element (29) on the inside of each of the four outer walls (40), with a support surface (45) protruding from the lower edge (43) of the outer wall (40) by the height of the wall (18), so that in the package state the wall (18) abuts on the support surface (45) of the support element (29) and the front surface (70) of the support plate (11) is arranged flush with the face of the lower edge (43) of the outer wall (40).

5. The package according to claim 3, in which the upper wall (42) of the frame element (19) comprises an arc-shaped portion with an edge portion (41) arranged parallel to the outer wall (40), the face (47) of which is arranged in the same plane as the support surface (45) of the support element (29).

6. The package according to claim 1, in which the support plate (11) is formed either semi-transparent, with a surface allowing a diffuse light transmission, or completely transparent.

7. The package according to claim 1, in which the support plate (11) is formed either continuously or continuously with a multitude of recesses or with a multitude of apertures or as a rigid grid with meshes of predetermined size.

8. The package according to claim 1 comprising at least one fixing element (30, 38) formed in such a way that the lid element (60), the frame element (19) and the support plate (11) are adapted to be jointly maintainable by the fixing element (30, 38) in the package state.

9. The package according to claim 8, in which the at least one fixing element (30, 38) comprises two cover portions (31, 32) arranged at a distance above each other and each having two lateral edges (33, 34) arranged at a right angle towards each other, wherein the cover portions (31, 32) are connected to each other in the area of their lateral edges (33, 34) by a side wall (35) arranged perpendicularly to them, wherein the fixing element (30, 38) in the package state surrounds at least the opposite corners of the package (10).

10. The package according to claim 8, in which the fixing element (30, 38) is formed as at least two clamps holding the lid element (60) and the support plate (11) together in the package state.

11. The package according to claim 1, in which the support plate (11) comprises several apertures (50) adjacent to the circumference, and the frame element (19) comprises pins (46) that are engageable with the apertures (50) in the frame state.

12. The package according to claim 1, in which the frame element (19) is formed in such a way that its outer wall (40)

is adapted to be affixable under tension on the lateral sides (13, 14, 15, 16) of the support plate (11).

13. The package according to claim 1, in which the lid element (60) is formed in such a way that its side walls is adapted to be affixable under tension in the recess formed by the step (80).

* * * * *